United States Patent [19]

Best

[11] Patent Number: 4,649,368

[45] Date of Patent: Mar. 10, 1987

[54] ELECTRICAL RESISTANCE HEATING ELEMENT

[75] Inventor: Lorne A. Best, West Bloomfield, Mich.

[73] Assignee: National Element, Inc., Troy, Mich.

[21] Appl. No.: 740,717

[22] Filed: Jun. 3, 1985

[51] Int. Cl.[4] ..... H01C 3/00; H01C 3/10; H01C 7/22; H05B 3/10

[52] U.S. Cl. ..... 338/283; 338/287; 338/279; 338/280; 338/285; 219/550

[58] Field of Search ..... 338/283, 279, 280, 281, 338/282, 284, 290, 291, 287, 328, 329; 219/550, 541

[56] References Cited

U.S. PATENT DOCUMENTS

| | | | |
|---|---|---|---|
| 600,057 | 3/1898 | Ball | 338/280 |
| 1,006,655 | 10/1911 | Harris | 338/281 |
| 1,335,483 | 3/1920 | Colby | 338/206 |
| 1,851,160 | 3/1932 | Cope et al. | 338/51 |
| 1,889,445 | 11/1932 | Lightfoot | 338/281 |
| 1,900,318 | 3/1933 | Van Valkenburg et al. | 338/280 |
| 1,928,142 | 9/1933 | Trent et al. | 201/74 |
| 2,059,349 | 11/1936 | Hertner | 201/69 |
| 2,875,310 | 2/1959 | Schoch | 201/69 |
| 2,969,516 | 1/1961 | DuBois | 338/284 |
| 3,086,187 | 4/1963 | Duggan et al. | 338/283 |
| 3,191,138 | 6/1965 | Wycoff | 338/287 |
| 3,373,239 | 3/1968 | Rubisch | 13/25 |
| 4,011,395 | 3/1977 | Beck | 13/25 |
| 4,016,403 | 4/1977 | Best | 219/550 |
| 4,147,888 | 4/1979 | Sato | 13/22 |
| 4,243,872 | 1/1981 | Best | 219/375 |
| 4,310,745 | 1/1982 | Bender | 219/213 |
| 4,337,390 | 6/1982 | Best | 219/532 |

OTHER PUBLICATIONS

Trent, Inc. "Box Type Furnaces".

*Primary Examiner*—Joseph W. Hartary
*Assistant Examiner*—Linda M. Peco
*Attorney, Agent, or Firm*—Cullen, Sloman, Cantor, Grauer, Scott & Rutherford

[57] ABSTRACT

A resistance heating element of the ribbon type for use in a high temperature electric furnace. The element has the same curved cross-sectional configuration throughout its entire length to give it strength and stiffness and permits the element to be bent into various patterns without any overlapping portions at the bends. The curved cross-section permits the element to be supported at the bends without the element sagging reducing the amount of heat absorption by the supports and allowing greater exposure of the element.

13 Claims, 15 Drawing Figures

ELECTRICAL RESISTANCE HEATING ELEMENT

BACKGROUND OF THE INVENTION

The present invention relates to a resistance heating element for use in an electric furnace. More particularly, the present invention relates to a continuous resistance heating element of the ribbon type that can be bent into various shapes to fit different electric furnaces and when bent substantially retains the same cross-sectional configuration along its entire length.

Conventional electric furnaces generally have one of the following resistance elements: a series of groups of parallel spaced wire sections supported within ceramic blocks or similar supporting means or a single continuous element folded into a series of spaced sections as illustrated for example in U.S. Pat. Nos. 4,147,888 and 1,928,142.

The first type of element, the spaced wire sections, requires numerous thick supports which generally are grooved with the wire being supported in the grooves. The use of this type of support has disadvantages in that it is inefficient because the support absorbs the heat created by the element until the support is the same temperature as the element. Further, the wire sections and supports add additional expense to the manufacturer of the furnace since each wire section and support must be individually made to appropriate lengths for each specific furnace.

The second type of element, the continuous resistance element, generally reduces the loss of heat through absorption because the element can be supported at its ends where the folds are made. This allows a larger area of the resistance element to be exposed making the element more efficient.

A problem with the continuous resistance element is the way the element is folded to conform to the furnace. At each fold, the element overlaps itself which increases the element density at that point and the resistance. Increased resistance increases the wattage at the fold which increases wattage per density causing the element to burn out at the folds reducing the life of the element.

In Beck, U.S. Pat. No. 4,011,395, an electric furnace heater is illustrated having a flat resistor ribbon which is bent into a serpentine pattern and does not have the problem of overlap at the bends. However, in order to support the ribbon the heater is formed with transverse rows, each row having a plurality of spacers and brackets to support the ribbon. The brackets are welded to the ribbon which increases the density of the ribbon at that point which can lead to a reduction in the life of the ribbon. Also, the necessity of welding each bracket is time consuming and makes replacement of the ribbon difficult.

BRIEF SUMMARY OF THE INVENTION

The present invention overcomes the above disadvantages by providing an improved elongated continuous resistance ribbon having a unique cross-sectional configuration which can be bent into a series of continuous serpentine or wave-like segments that do not overlap themselves and which can be supported within upper and lower supports.

Each of the continuous segments is generally U-shaped having a curved end section and two generally straight side sections all lying in a first plane. The cross-sectional configuration is curved in a second plane perpendicular to the first plane and remains substantially unchanged even when the ribbon is bent. The curved cross-section provides stiffness and strength to the metallic ribbon.

The upper and lower supports have a channel portion for receiving the curved end sections of the ribbon permitting substantially the entire ribbon to be exposed.

Connected at each end of the ribbon is a connecting block, which can be connected to a power source for providing current to the ribbon.

In the preferred embodiment, the ribbon is used in a high temperature furnace having temperatures in excess of 1250° F. The unique cross-sectional configuration of the ribbon allows a thinner ribbon to be used and for it to be supported along the curved end sections without the problem of the ribbon sagging under its own weight.

Further, in the preferred embodiment, the ribbon's cross-section is substantially in the form of a sinusoidal wave having at least one full cycle and one half cycle, as for example, 1½, 2½, or 3½ cycles. This permits a new section of ribbon to be unwound from a roll of ribbon and attached to a section of existing ribbon without regard to whether the roll has been unwound from the top or bottom. Other examples of cross-sectional configurations of the ribbon include the following: two ribbed outer sections interconnected by a flat inner section; a series of ribbed sections substantially forming a sinusoidal wave having full cycles; a flat inner portion having opposed raised outer end sections; a plurality of ribs alternating in opposite directions in the second plane; a substantially straight inner section having opposed end sections wherein the end sections are a series of ribs alternating in opposite directions; or a flat, substantially straight inner section having downwardly extending side sections. Each of the cross-sectional configurations are substantially rounded at their upper surface permitting easy positioning and manipulation of the ribbon into the upper and lower supports.

The resistance element is made by forming a flat metal ribbon, as for example by cold rolling, into an elongated continuous metallic ribbon with a curved cross-sectional configuration. The ribbon is then bent into a series of substantially adjacent oppositely alternating U-shaped regions with said curved cross-sectional configuration remaining substantially unchanged.

Further, a unique method is provided for connecting the ends of the ribbon to the power source. The method includes adding two short additional ribbons to each side of each end of the ribbon and attaching the three ribbons to a connecting block. The three ribbons are then all attached together as, for example, by welding along their top and bottom edges.

DETAILED DESCRIPTION OF THE PREFERRED EMBODIMENT

Figure 1:
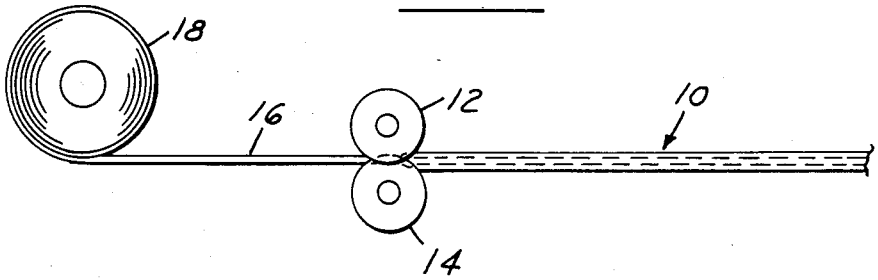
FIG. 1 is a side view of the cold rolling process used in forming the continuous resistance ribbon type heating element of the present invention.

With reference to FIG. 1, the process for forming the resistance element of the present invention is illustrated. The process includes cold rolling a stock of conductive material 10, as for example Nichrome V a material comprising nickel and chrome, between two rollers 12 and 14 to form the resistance element 16. Element 16 may be conveniently stored in large rolls 18. Element 16 is formed with a curved cross-section, as illustrated in FIGS. 2 through 4, 8 through 9 and 14 and 15, to provide stiffness and strength.

Figure 2:
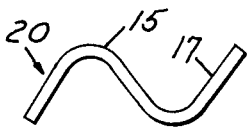
FIG. 2 is a first embodiment of the cross-sectional configuration of the resistance ribbon type heating element.
Figure 3:
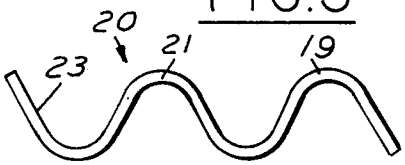
FIG. 3 is a second embodiment of the cross-sectional configuration of the resistance ribbon type heating element.
Figure 4:
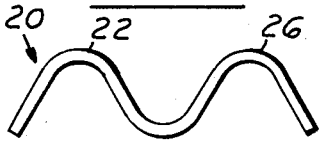
FIG. 4 is a third embodiment of the cross-sectional configuration of the resistance type heating element.
Figure 8:
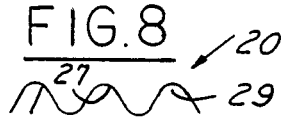
FIG. 8 is a fourth embodiment of the cross-sectional configuration of the resistance ribbon type heating element.
Figure 9:
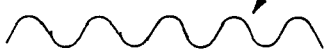
FIG. 9 is a fifth embodiment of the cross-sectional configuration of the resistance ribbon type heating element.
Figure 10:
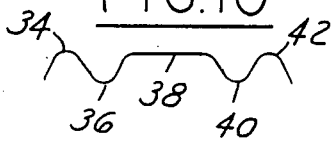
FIG. 10 is a sixth embodiment of the cross-sectional configuration of the resistance ribbon type heating element.

With reference to FIGS. 2 and 3, the preferred embodiments of the curved cross-sectional configuration are illustrated in the form of a sinusoidal wave 20 having one full cycle 15 and one half cycle 17, FIG. 2, and two full cycles 19 and 21 and one half cycle 23, FIG. 3. These configurations permit a new section of ribbon to be unwound from a roll of ribbon and attached to a section of existing ribbon without regard to whether the roll has been unwound from the top or bottom which makes assembly much easier and less time consuming. With reference to FIGS. 4, 8 and 9, further embodiments of the curved cross-sectional configuration are illustrated in the form of a sinusoidal wave 20 having at least one full cycle. FIG. 4 illustrates wave 20 having two full cycles 22 and 26. FIG. 8 illustrates wave 20 having three full cycles 25, 27 and 29. FIG. 9 illustrates wave 20 with five full cycles. The additional cycles provide greater strength. With reference to FIG. 10, the sixth embodiment of the curved cross-section is illustrated having a first raised section 34 which descends to an inverted rib 36 which raises to a flat substantially straight plateau 38 which then descends to a second inverted rib 40 which ends in a second raised section 42. A seventh embodiment, illustrated in FIG. 14, has a first raised section or rib 28 which descends to a flat straight region 30 and ends in a second raised section or rib 32.

Figure 15:
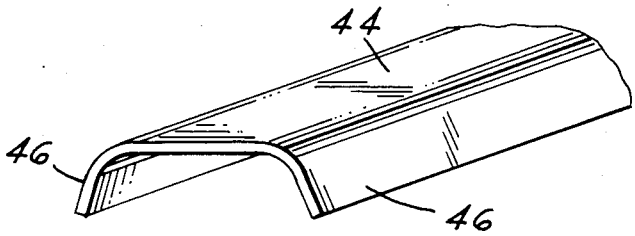
FIG. 15 is an eighth embodiment of the cross-sectional configuration of the resistance ribbon type heating element.

In FIG. 15, the eighth embodiment is illustrated having a flat upper surface 44 with descending sides 46.

The curved cross-section allows thinner metals to be used and reduces sagging at high temperatures. Additionally, since the curved cross-section retains substantially the same configuration after being bent, the ribbed or raised sections add strength to the ribbon permitting the ribbon to rest within supports obviating the need for overlapping or for the addition of special attaching means.

Figure 5:
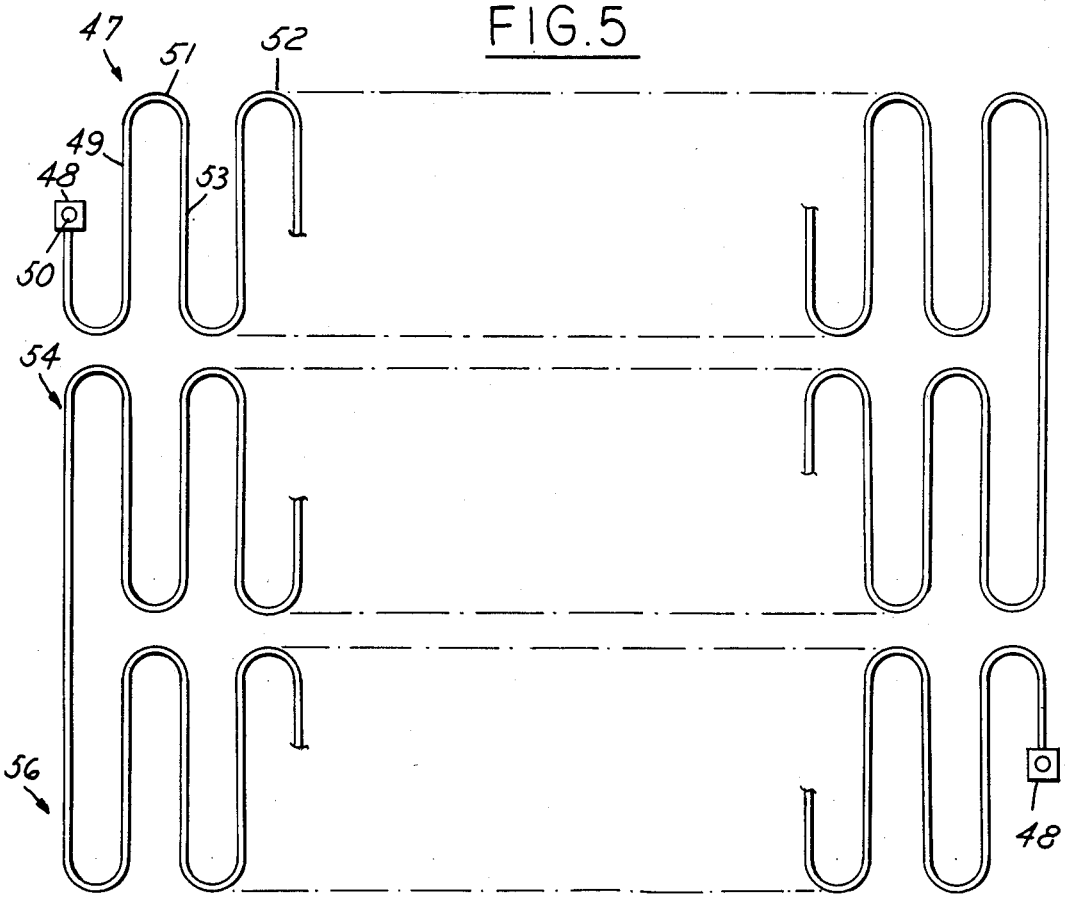
FIG. 5 is a side view of the resistance ribbon type heating element having three passes and multiple segments.

Element 16 may be bent into various different patterns without any overlapping because of the curved cross-section. With reference to FIG. 5, a three pass serpentine resistance element 47 is illustrated having a first pass 52, a second pass 54 and a final pass 56 all formed from one continuous resistance element 16. Each of passes 52, 54 and 56 is formed by bending element 16 into a series of substantially adjacent oppositely alternating U-shaped segments. Each segment has a bend or curved section 51 which extends into a first leg 49 and a parallel second leg 53.

Figure 6:
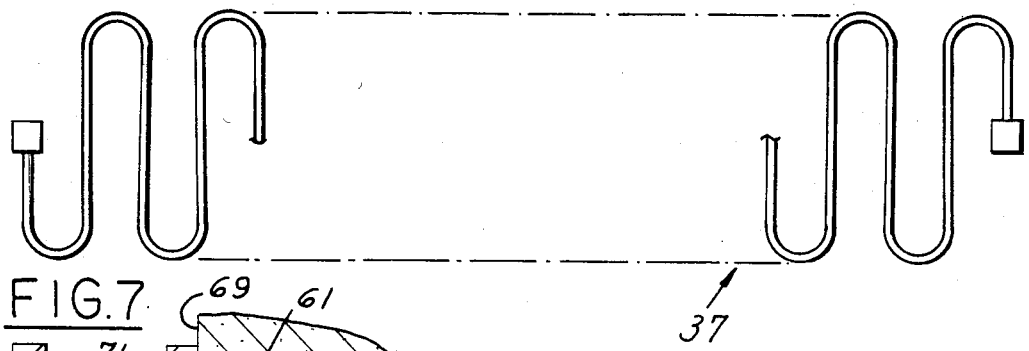
FIG. 6 is a side view of another resistance ribbon type heating element having a single pass and multiple segments.
Figure 11:
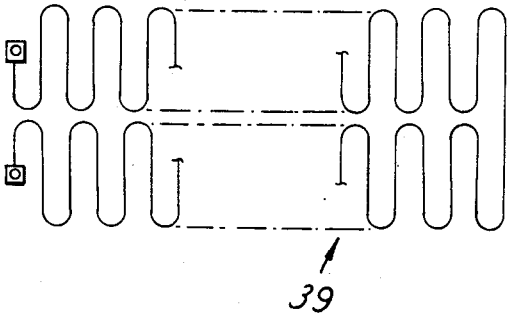
FIG. 11 is a side view of a two pass, multiple segment ribbon type heating element.
Figure 12:
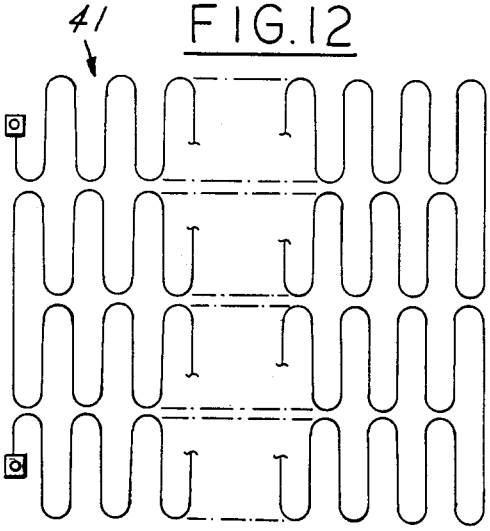
FIG. 12 is a side view of a four pass, multiple segment ribbon type heating element.

With reference to FIGS. 6, 11 and 12, further embodiments of the serpentine pattern are illustrated, FIG. 6 illustrating a single pass serpentine 37, FIG. 11 illustrating a two-pass serpentine 39 and FIG. 12 illustrating a four-pass serpentine 41. It being understood to one of ordinary skill in the art that any number of passes could be formed and any pattern could be obtained by merely bending the ribbon 16 into the desired pattern.

At each end of resistance element 16 a connecting block 48, as for example a stainless steel connecting block, is attached to interconnect element 16 with an electric power source. The connecting block 48 has an opening 50 for facilitating the connection.

Figure 13:
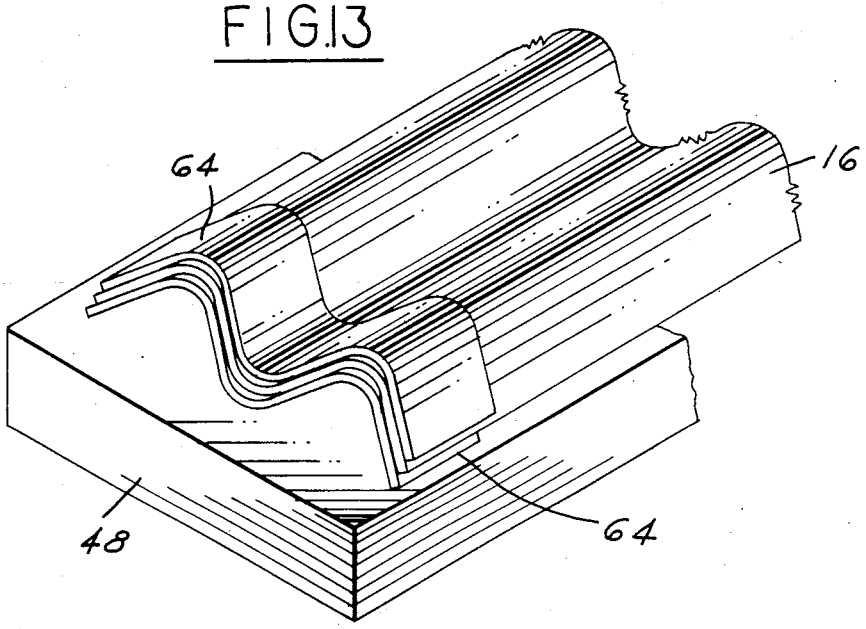
FIG. 13 is a perspective view of a preferred method of attaching the resistance ribbon type heating element to a connector block.
Figure 14:
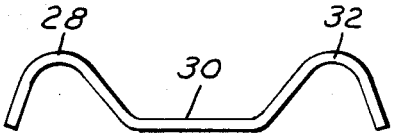
FIG. 14 is a seventh embodiment of the cross-sectional configuration of the resistance ribbon type heating element.

In the preferred embodiment, with reference to FIG. 13, the connecting block 48 is connected to the ends of element 16 by attaching additional one-inch-long pieces of element 64 on each side of element 16 and welding the three ribbon ends to connecting block 48. The three ribbons are then welded together along the top and bottom edges to within one-quarter inch of the ends of the two additional pieces. This type of connection is sturdy, efficient and reduces the possibility of the welding process burning through the ribbon.

Figure 7:
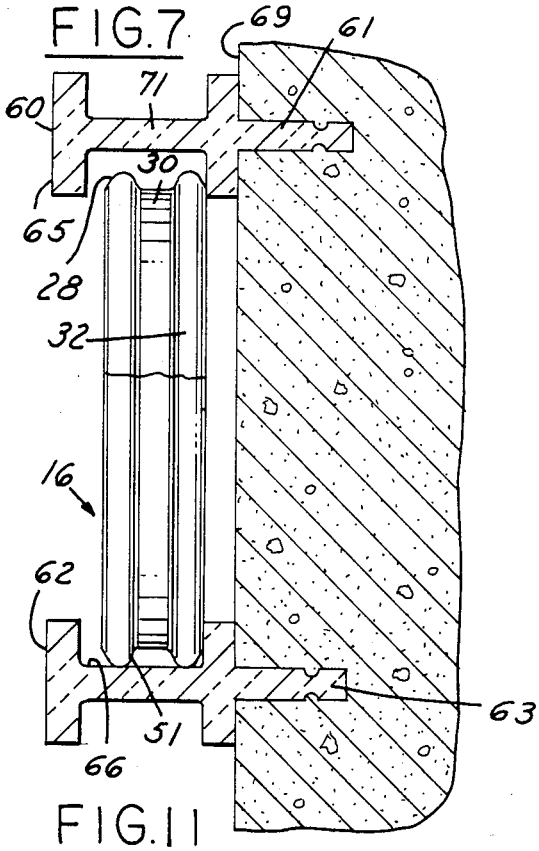
FIG. 7 is a side view of the resistance ribbon type heating element supported within an electrical furnace, partially shown, on upper end lower supports.

Referring now to FIG. 7, in the preferred embodiment, element 16 is supported upon a lower support 62 and retained in position by an upper support 60. Support 60 and 62 are H-shaped, providing channels for element 16 to be supported therein. Inserts 63 and 61 may be inserted into the wall 69 of the furnace for retaining supports 60 and 62. The lower bend of curve 51 rests upon the surface 66 of lower support 62 which allows lateral and vertical movement and the upper bend or curve 51 is retained within upper support 60 which allows lateral and vertical movement. Element 16 is supported in this manner to allow for growth expansion and to permit element 16 to slip fit in and out of the supports.

By using supports 60 and 62 and due to the strength provided by the curved cross-section at the bends or curves 51, more of element 16 is exposed which makes element 16 more efficient. Also, with less contact between element 16 and supports 60 and 62 and the corresponding reduced need for ceramic, the supports do not absorb as much heat and are therefore again more efficient.

A major advantage of the strengthened bends or curves 51 is the elimination of any overlapping of element 16 which extends its life because the watt per density is reduced. Also slightly higher operating temperatures can be obtained because of the elimination of overlap.

It will be apparent to those skilled in the art that the foregoing disclosure is explanatory in nature rather than limiting, the invention being limited only by the appended claims.

What is claimed is:

1. An electrical resistance heating element for use in a high temperature electrical furnace, said furnace having upper and lower supports arranged in a pattern into which said element is positioned for providing proper heat distribution, said resistance element comprising:

an elongated continuous metallic ribbon bendable into a series of continuous segments, said segments being positionable within the upper and lower supports;

each of said continuous segments being generally U-shaped having a curved end section and two generally straight side sections all lying in a first plane, said end section having a cross-sectional configuration substantially similar to the cross-sectional configuration of each of said straight side sections, whereby said ribbon has the same cross-sectional configuration along its entire length;

said cross-sectional configuration at any place along the entire length of the ribbon being curved in a second plane perpendicular to said first plane to provide stiffness and strength to said ribbon.

2. The resistance heating element of claim 1, wherein said curved end sections are received within the upper and lower supports;

said supports having a channel portion for receiving said curved end sections, whereby said supports permit substantially the entire ribbon to be exposed.

3. The resistance heating element of claim 1, wherein said ribbon has first and second ends, each end being electrically connected to a connecting block, said connecting block being connected to a power source.

4. The resistance heating element of claim 1, wherein the cross-sectional configuration of said ribbon comprises a series of ribbed sections substantially forming a sinusoidal wave pattern;

said series of ribbed sections including at least one full cycle and one partial cycle;

whereby a new section of ribbon may be unwound from a roll of ribbon and attached to a section of existing ribbon without regard to whether the roll has been unwound from the top or bottom.

5. The resistances heating element of claim 1, wherein the crosssectional configuration of said ribbon comprises two ribbed sections interconnected by a flat section.

6. The resistance heating element of claim 1, wherein the cross-sectional configuration of said ribbon comprises a series of ribbed sections substantially forming a sinusoidal wave pattern.

7. The resistance heating element of claim 1, wherein the cross-sectional configuration of said ribbon comprises a flat inner portion having opposed raised outer end sections.

8. The resistance heating element of claim 1, wherein the cross-sectional configuration of said ribbon comprises a plurality of ribs alternating in opposite directions in said second plane.

9. The resistance heating element of claim 1, wherein the cross-sectional configuration of said ribbon comprises a flat substantially straight inner section having opposed end sections;

said end sections being a series of ribs alternating in opposite directions.

10. The resistance heating element of claim 1, wherein the cross-sectional configuration of said ribbon comprises a flat substantially straight inner section having downwardly extending side sections.

11. The resistance heating element of claim 1, wherein said furnace temperature exceeds 1250° F.

12. A method of making an improved electrical resistance heating element for use in a high temperature electric furnace by a cold rolling process, said method comprising the steps of:

forming an elongated continuous metallic resistance element with a curved cross-sectional area from a quantity of flat ribbon stock by moving the stock through a pair of opposing rotatably supported rollers having a configuration to form the required curved cross-sectional area on the stock for strengthening the ribbon stock;

bending said ribbon stock into a series of substantially adjacent oppositely alternating U-shaped segments with said curved cross-sectional area remaining substantially unchanged;

supporting said U-shaped segments within upper and lower spaced ceramic insulators; and connecting said ribbon stock at opposite ends to an electrical output.

13. The method of claim 12, wherein said method of connection comprises:

adding two short additional layers of ribbon stock to each side of each end of said stock, attaching said layers to a connecting block; and attaching all three layers together along top and bottom edges thereof.

* * * * *